US005674088A

United States Patent [19]

Roche et al.

[11] Patent Number: 5,674,088

[45] Date of Patent: Oct. 7, 1997

[54] QUICK RELEASE CONNECTORS FOR ELECTRICAL TERMINALS

[76] Inventors: Peter Roche; Eduardo Rodriguez, both of Passeig De L'Estacio 14, Valls Tarragona 43800, Spain

[21] Appl. No.: 488,865

[22] Filed: Jun. 9, 1995

[30] Foreign Application Priority Data

Mar. 7, 1995 [ES] Spain ..... 9500446

[51] Int. Cl.[6] ..... H01R 13/434

[52] U.S. Cl. ..... 439/354; 439/357; 439/595

[58] Field of Search ..... 439/354, 595, 439/353, 357, 358

[56] References Cited

U.S. PATENT DOCUMENTS

| | | | |
|---|---|---|---|
| 4,749,372 | 6/1988 | Betsui | 439/595 |
| 4,932,899 | 6/1990 | Sueyoshi et al. | 439/595 |
| 4,944,696 | 7/1990 | Sueyoshi et al. | 439/595 |
| 4,973,268 | 11/1990 | Smith et al. | 439/595 |
| 5,044,991 | 9/1991 | Colleran et al. | 439/595 |
| 5,071,369 | 12/1991 | Denlinger et al. | 439/595 |
| 5,088,938 | 2/1992 | Mucakami et al. | 439/595 |
| 5,151,052 | 9/1992 | McCardell | 439/595 |
| 5,187,862 | 2/1993 | Ohsumi | 439/595 |
| 5,261,836 | 11/1993 | Okabe | 439/595 |
| 5,273,456 | 12/1993 | Muzslay | 439/595 |
| 5,281,168 | 1/1994 | Krehbiel et al. | 439/595 |
| 5,308,265 | 5/1994 | Kaneko | 439/595 |
| 5,316,504 | 5/1994 | Jinno | 439/595 |
| 5,356,302 | 10/1994 | Inoue et al. | 439/595 |
| 5,425,656 | 6/1995 | Wakata | 439/595 |
| 5,427,548 | 6/1995 | Yagi et al. | 439/595 |

FOREIGN PATENT DOCUMENTS

| | | | |
|---|---|---|---|
| 277822 | 8/1988 | European Pat. Off. | 439/595 |
| 2248350 | 4/1992 | United Kingdom | 439/744 |

*Primary Examiner*—Gary E. Elkins
*Attorney, Agent, or Firm*—Dowell & Dowell

[57] ABSTRACT

A connector for releasably securing electrical terminals which includes a body having a first cavity in which an electrical terminal may be selectively received and a second cavity in which a spacer member may be slidingly received. The spacer member is engageable with a retention element formed along a first partition separating the first and second cavities so as to urge the retention element into engagement with a terminal selectively seated within the first cavity. The spacer member is also retained by a separate retention element in different portions within the second cavity dependent upon the proper seating of a terminal within the first cavity. The connector further includes a housing in which the body may be selectively received and quickly released by a yieldable retention element extending along an outer portion of the connector body.

19 Claims, 5 Drawing Sheets

FIG. 7
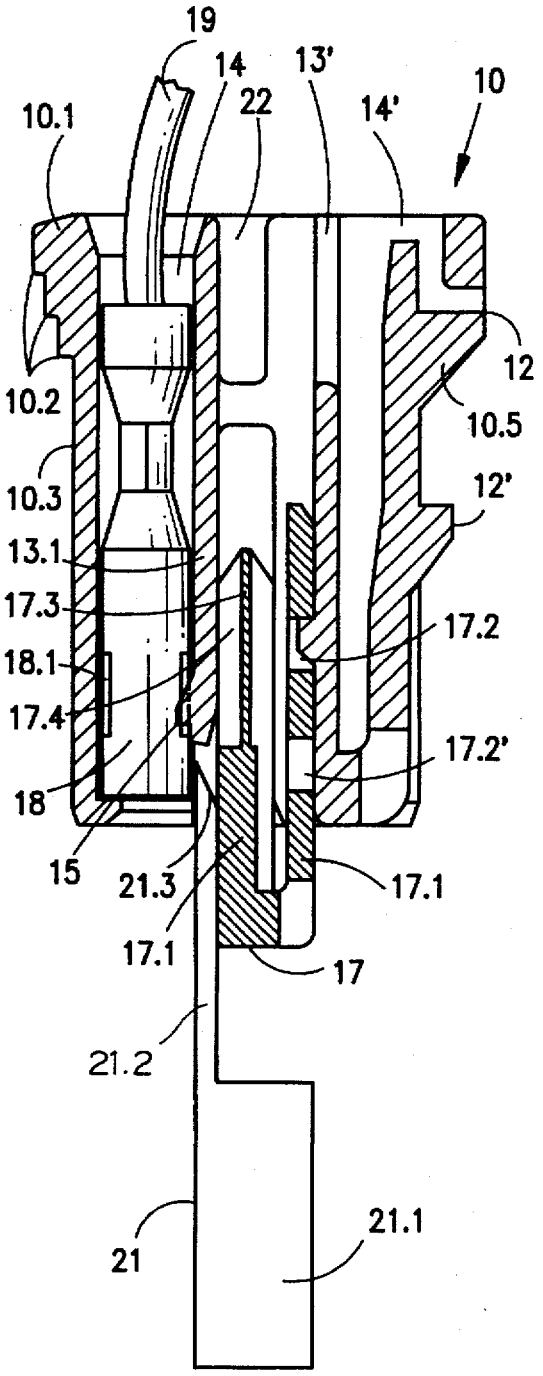
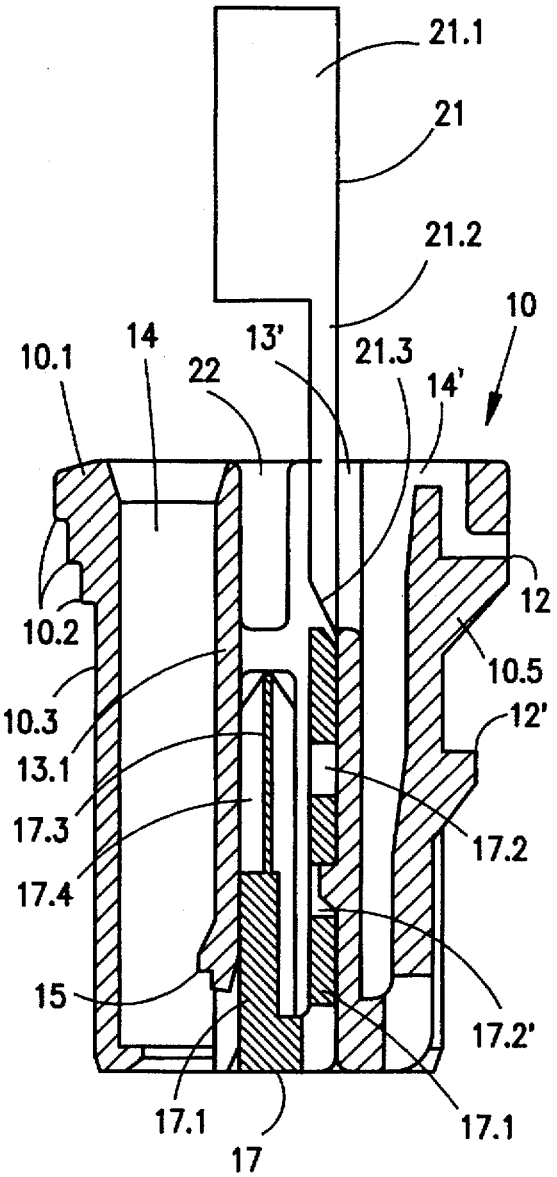
FIG. 8

QUICK RELEASE CONNECTORS FOR ELECTRICAL TERMINALS

BACKGROUND OF THE INVENTION

1. Field of the Invention

The present application is directed to improved safety connectors, whose new features fulfill the performance for which they have been developed, with a maximum of efficiency and safety.

2. History of the Related Art

There are several types of connectors in the market, which can be considered as the state of the art, designed for housing male and female terminals for a quick coupling between the connector's housing and male terminals and the connector's housing and female terminals. In these types or models of terminals there are important features allowing safety for the insertion of the terminals inside the connectors, as well as, to avoid the undesired separation of the terminals cavities into which the inside of the connector body is divided. Further features allow the insertion of the connector into a housing element in such a manner that the extraction is made as easy as the insertion.

The high degree of reliability requirements set by the automotive industries with regard to eventual failure allowable to such connectors, of one for a maximum of every 100,000 cars, requires that all terminal and connector manufacturers need to create safety features to avoid failure. This is especially true as any mishandling in the assembly of the connectors and terminals may cause an electrical failure resulting in an undesired failure of the vehicle. These high requirements, therefore, compel all manufactures of the connectors and terminals to search for a number of features in the connectors that are superimposed over their own design, and whose purpose is to meet the standards required by the car manufacturers.

Some of the several safety requirements for the connectors are as follows:

The connectors must have an upper zone through which the terminals enter so as to avoid interference with other wires, and also act as a support surface to allow a worker to press the connector to insert it in a housing element or in a counterpart;

The extraction of the connector from the housing element or counterpart must be easy;

A spacer must be provided in two working positions;

Check zones must be provided between the spacer and the retention elements of the terminals; and when desired, provision for withdrawing the spacer in order to enable the removal of a misplaced terminal.

The assembly of a connector consists in the introduction, by hand or automatically, of a series of terminals, fitted to the ends of a corresponding series of electric wires, into cavities formed in the connector. The terminals fitted to the ends of the wires have a series of openings whose purpose is to perceive retention elements supplied in the inside of the cavities of the connector, which, when introduced in the cavities, cause the terminals to be retained by the elements, thus preventing the terminal or terminals from escaping from the cavity owing to vibrations of a car in movement. Once all the terminals are inserted in the cavities of the connector, it is important that the connector has been designed for being insertable with a slight pressure into a counterpart or housing element in the easiest possible way.

In order to accomplish the foregoing, several features have been designed, currently available in the market and therefore considered the state of the art, consisting of a series of short legs emerging from a base of the connectors, which are part of the lateral faces of the connectors and protrude, therefore, whose function it is, being flexible, to flex inwardly of the connector's box or housing when introduced into the housing element or counterpart. The insertion and retention of the connector is facilitated by means of spurs provided on the short legs.

Daily practice in the assembly of such connectors demonstrates how the presence of spurs emerging from the connector body and protruding therefore, interfere with neighboring wires that are to be incorporated into the wiring of a car, since the connectors are nothing else than the terminal elements of such wires whose purpose is to connect the elements between the different car devices.

SUMMARY OF THE INVENTION

In order to avoid such interference, the present invention provides a design feature for the retention of the connector inside the housing or counterpart in such a way that spurs or retention elements protruding from the connector body do not alter the useful width of the connector, thus preventing the spurs or retention elements interfering with other wiring, which could cause a malfunction in the wiring system.

When all the terminals are fitted inside the cavities arranged in a connector and all the retention elements of these cavities have penetrated into openings arranged in the terminals, the connector is introduced between a conventional spacer which is provided to exert pressure on the retention elements, by means of its lateral faces, in order to retain the retention elements securely connected inside the cavities in such a way that the elements cannot be dislodged because of a car's vibrations. Anyhow, the provision of the spacers has caused that, when the terminal has been misplaced, the retention elements interfere with the spacers. The spacers are often installed automatically, causing the destruction of the retention elements and, in some cases, it may appear from the outside that a spacer is inserted entirely inside a cavity, while the terminal remains in a position that, given vibrations associated with a car in motion, the terminal may separate from the cavity and interrupt the electric feed to a service associated with the terminal. As known in the state of the art, the spacer has two working positions: one for the pre-assembly position and another for the assembly position. In the first position, the spacer is introduced only partially in the cavity prepared to that effect, normally in the same plants where the connectors are manufactured, and the assemblies are thereafter sent to plants where the wirings are assembled and where terminals are fitted inside the connectors.

Daily practice has shown that, when the connectors arrive at the plants where the assembly takes place, many of the spacers partially introduced into the cavities have separated from the connectors. It then becomes necessary to replace each spacer into the pre-assembly position. Since in many of these plants the function of assembling the terminals is performed automatically, it is mandatory first to replace the spacers in the cavities by hand, with the subsequent loss of time. In order to overcome these drawbacks, the safety features of the present invention incorporates in one of the wings of the spacer two openings which prevent, in combination with spurs or projections disposed in one of the partitions of the housing, the possibility of the spacer coming loose during the transport from the connector's manufacturing plant to the assembly plant where the connectors and the corresponding wiring and conductor wires are assembled.

Another fact related to the assembly of the spacers inside of the cavities is that another function of the spacers is that of ascertaining whether the projection elements inside the cavities had been lodged inside of the appropriate openings of the related terminals or not. To date, it often happens that when a terminal has been incorrectly placed inside the cavity and the corresponding spacer is inserted, it breaks and tears away the corresponding retention elements of the terminal and, when the container is inspected from the outside, it appears that all of the terminals are solidly fitted, although in many cases they are not. To avoid these inconveniences, the newly designed spacers incorporated into the housing have a safety feature consisting in check zones which do not allow the spacer, when passing from the pre-assembly position to the assembly position, to be totally fitted or engaged with the bottom of the cavity, if the connector has been misplaced. It is therefore possible to make quick identification of the terminal which is not correctly placed along its entire length in a corresponding cavity.

As regards the above safety features, it is also not possible to remove a spacer from a cavity once it has been introduced after it is detected as faulty as the retention zones that are placed inside the connector for fixing the terminal may be broken or crushed, making it necessary to reject the entire connector. To avoid these additional drawbacks, the safety features of the present invention have been designed in a way where it is possible to introduce a corresponding device for extracting a spacer from a cavity and thus fit a terminal in its correct position and replace the spacer to the bottom of its depth or working length.

BRIEF DESCRIPTION OF THE DRAWINGS

Other details and features of the present invention will become clear along with the description that follows, where reference is made to the appended drawings in which the preferred details are schematically represented. These details are given for an incorporation of the invention referring to a case of practical application, but are given as illustrative only and not limiting to the scope of the invention.

FIGS. 7 and 8 are elevation longitudinal sections of a connector 10 with the spacer 17 in position "A" (FIG. 7) and in position "B" (FIG. 8) with a device 12 inserted into the spacer's cavity for applying its inclined plane 21.3 against the inclined plane 17.6 of one of the legs 17.1 of the spacer 17.

DESCRIPTION OF THE PREFERRED EMBODIMENT

In the preferred embodiments of the present application as can be seen in the FIGS. 1–2, 7 and 8, a connector 10, is compromised of a prismatic body having in the upper end a wider upper part 10.1.

Figure 2:
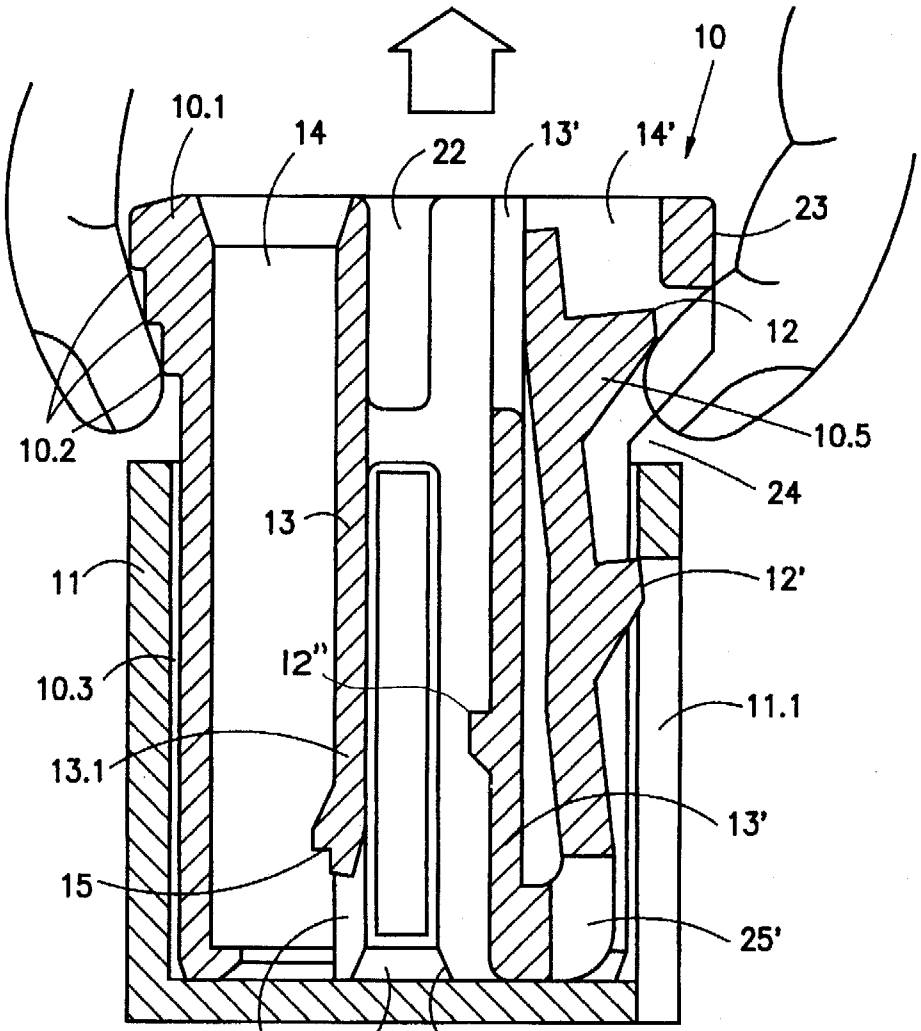
FIG. 2 is a longitudinal section of the connector 10 of FIG. 1 at the time when a user's fingers press the retention element 10.5 causing the spurs 12 to move out of a longitudinal groove 11.1 and allowing the easy extraction of the connector from the inside of the housing 11.
Figure 1:
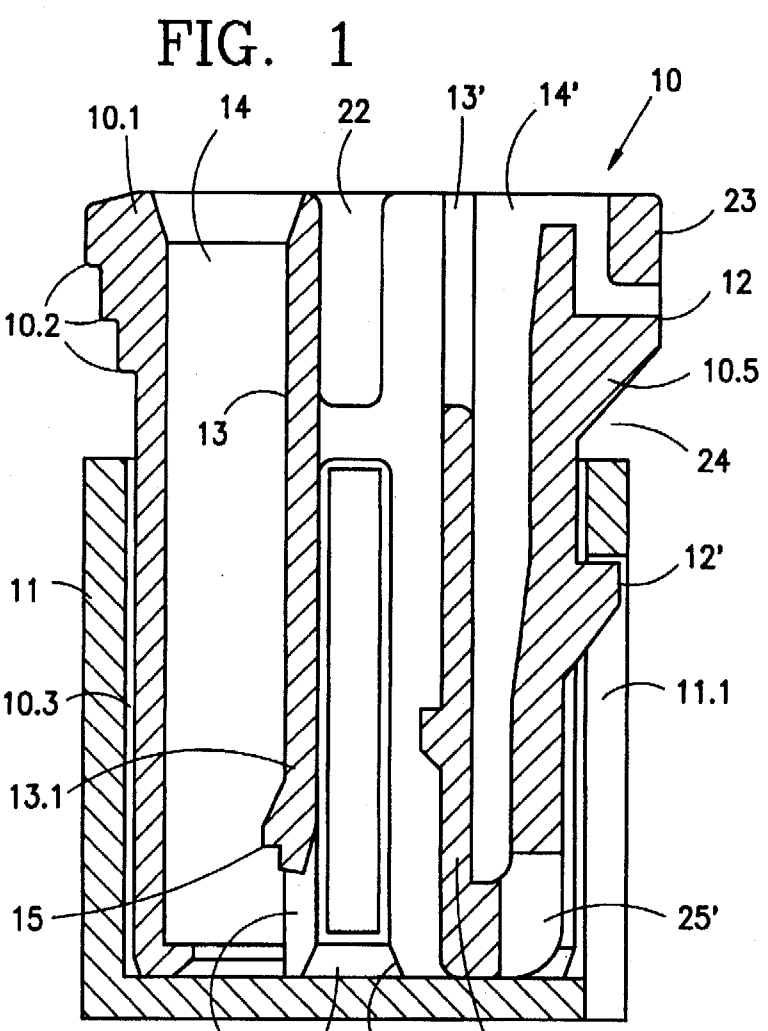
FIG. 1 is a longitudinal cross-sectional view of a connector 10 inserted into a housing element 11 or counterpart and retained inside by spurs 12 fitted in the corresponding retaining elements.

As can be seen in FIGS. 1 and 2, the connector's inner space is divided by a series of partition 13/13' forming cavities 14/14' to allow the introduction of terminal 18 into cavities 14 as well as other cavities 22 for introducing a spacer 17. The wider upper part has a different configuration in the opposing face of its outside surface. One of the faces is provided with a stepped zone 10.2 whereas in the opposing face is a flat zone 23 neighboring an open space 24 positioned above a housing 11 having a longitudinal slot 11.1 in one of the sidewalls thereof.

Figure 4:
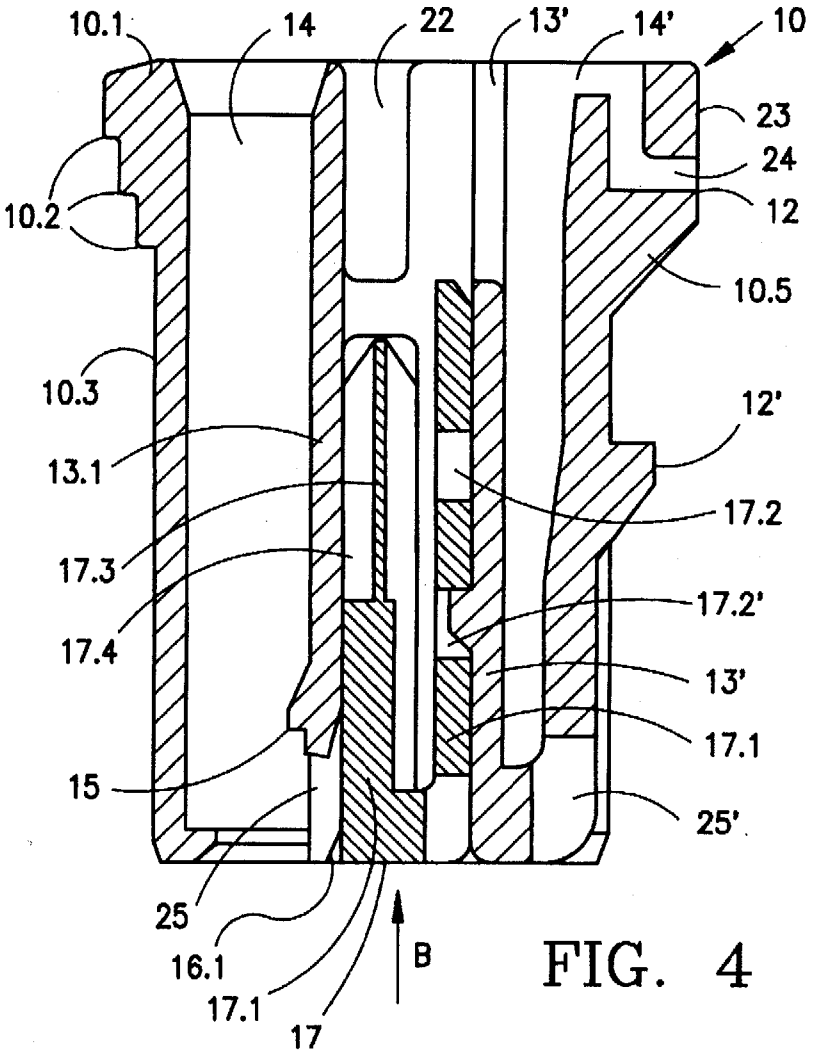
FIG. 4 is an elevation longitudinal section of a connector 10 when the spacer 17 is in a "B" position, that is, when the spacer is totally inserted in the spacer's lodging cavity 22.
Figure 3:
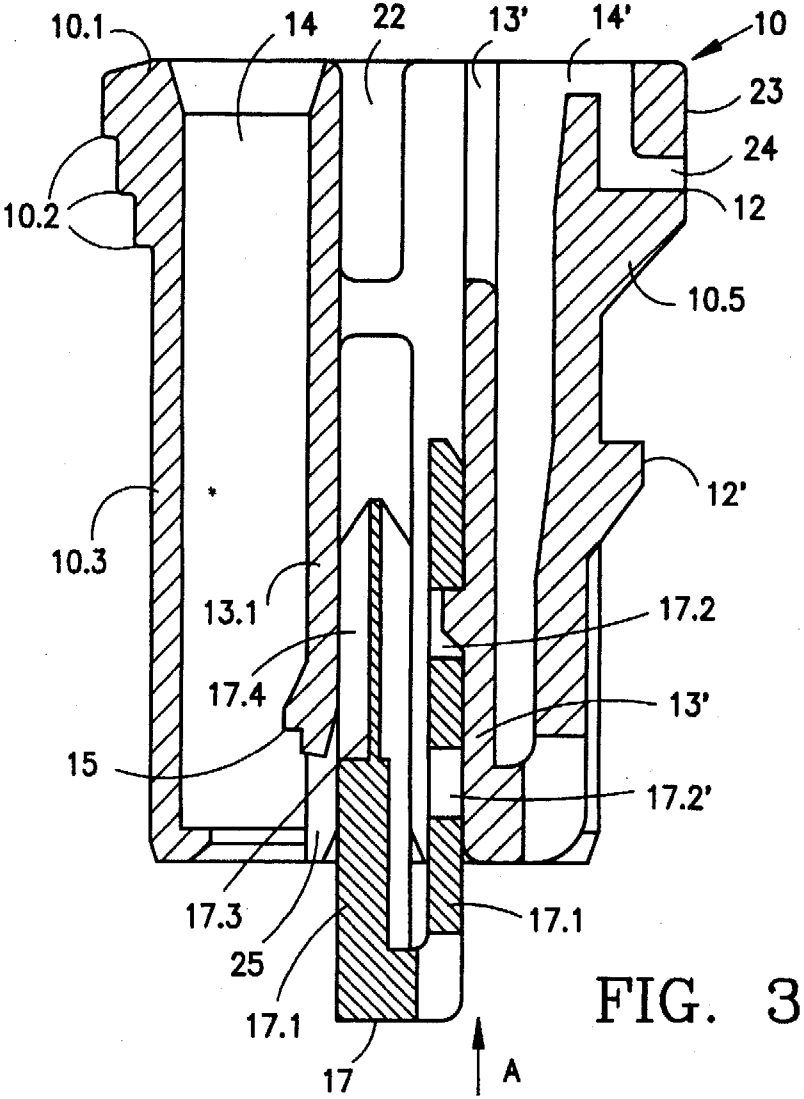
FIG. 3 is an elevation longitudinal section of a connector 10 in which the spacer 17 is in a pre-assembly "A" position, that is, when a first of the openings 17.2 of the spacer 17 is retained by a spur 12'.

The function of the stepped zone 10.2 combined with the flat zone 23 and a projection 12 in the surface of the retention element 10.5 is to be pressed by the user, as shown in FIG. 2, and flexed inwards leaving the projection 12 out of the open space 24 and a locking spur member 12' free of the longitudinal slot 11.1 of the housing 11. The partition 13' extends to the retention element 10.5 and an opening 25' is provided to allow flexing of element 10.5. The partition wall 13 forming the cavity 14 has an opening or space 25 so that the partition wall includes a flexible portion 13.1 which can be flexed by the ends so that a spur or projection 15 is seated in openings 18.1, as shown in FIG. 7, situated at the lateral sides of a terminal 18 mounted at the end of an electrical wire 19. When introducing a terminal 18 inside of the cavities 14, the connector 10 has other cavities 22 available for the spacers 17 to enter. The spacer's 17 cross-section is U-shaped with legs 17.1 of different heights and configuration, as can be seen in FIGS. 3, 4, 7 and 8 and have been designed with a feature allowing two working positions: in the first position, as shown in FIG. 3 as "A", the upper one of the openings 17.2 fits with one of the spur or projections 12", making it impossible for the spacers 17 to be removed from the cavities 22 during the transport of the connectors 10 carried in containers from one plant to another and arriving at destination separate from their respective connector 10. In a second working position "B," as shown in FIG. 4, the second or lower opening 17.2' of the spacer 17 is retained by the corresponding spur 12".

In one of the spacer's legs 17.1, there is a central flange 17.3 forming a rigid center portion and left and right flexible flanges 17.4 which serve to ease the spacer's introduction into the mouth 16 in the connector's base. This is helped by inclined edges 16.1 of the mouth.

Figure 5:
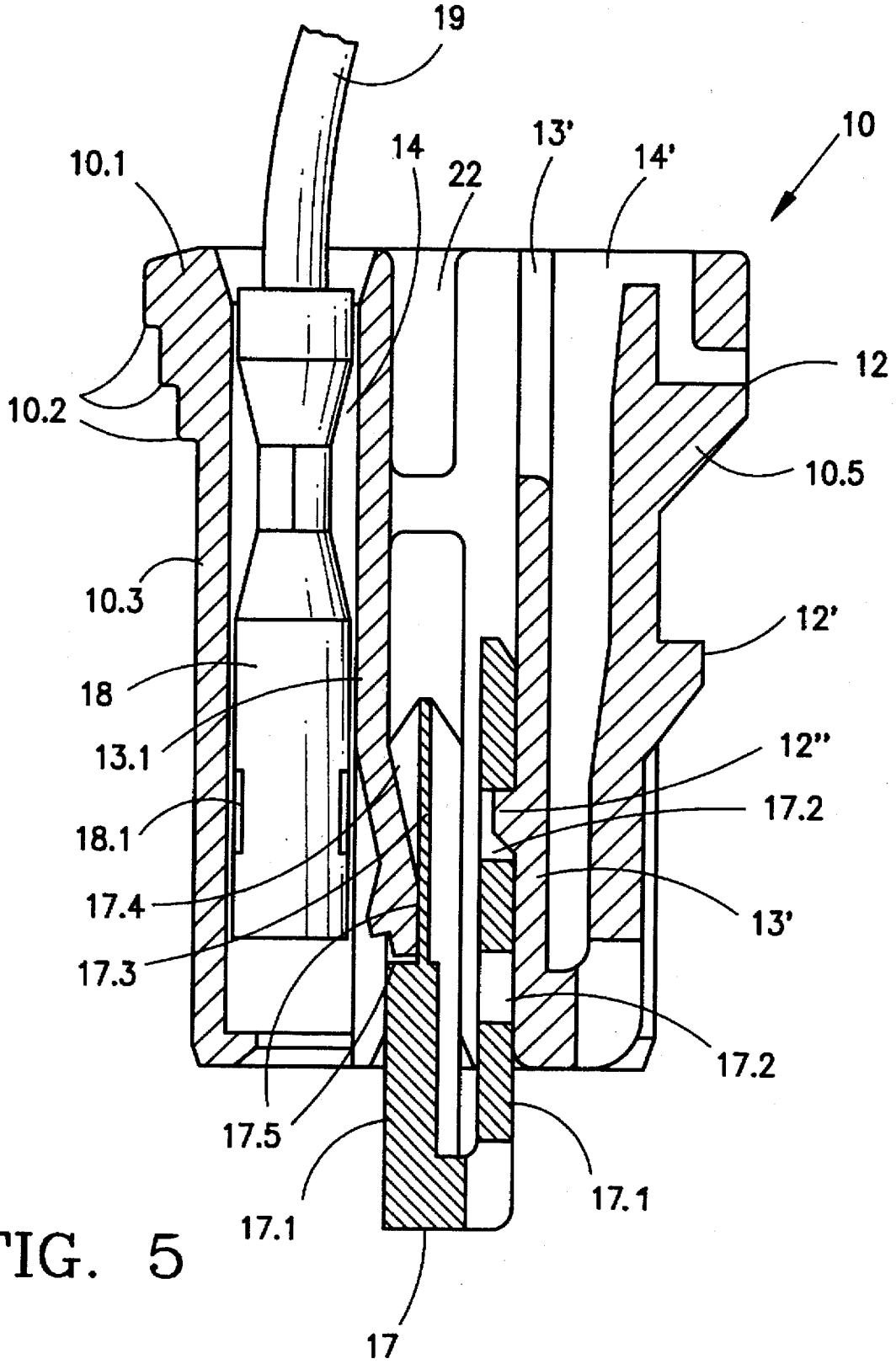
FIG. 5 is an elevation longitudinal section of a connector 10 when a terminal 18 has been wrongly inserted into the connector's 10 cavity 14 and, because of that, the openings 18.1 cannot fit with the spur 15, and the spacer 17 cannot be inserted into the cavity owing to the interference of the check zones in the spacer with the check zones of the spur 15.

The other novel feature of the spacer is as shown in FIG. 5, revealing clearly when the terminals placement into the cavities 14 is not correct, owing to the check zones or abutment walls 17.5 engageable by the deformable portions 13.1, and that of zones neighboring the rigid center flange 17.3, which hinder the spacer 17 from entering position "B" inside the cavity 22. Owing to that, the operator perceives that in the connector 10 exist one or several terminals 18 inside the cavity 14 which, owing to car movement vibrations, would come loose from the cavity 14 causing, therefore, an undesired failure.

Because of the above explanation, it is equally important to have a structure that allows the spacer 17 to be extracted from the cavity 22 when the terminal 18 is fitted improperly. This is possible thanks to the design of a device 21, as shown in FIGS. 7 and 8, which comprises a user's holding body 21.1 and a bar 21.2 having an inclined plane 21.3 at the end for contacting the spacer's plane 17.6. The plane 21.3 flexes one of the spacer's legs inwards and allows the spacer to be extracted from the cavity 22 and the terminal.

The above described features for the connector 10 can be applied to the one described in the appended figures and to any type of connector having the cavities 14 inside for introducing terminals 18 mounted at the end of the wires 19, by which the inventive concept of the instant invention is applicable to other connector types not shown in the figures. This structure avoids interference of the terminal's 10 upper part 10.1 with other wires that could remain adjacent the upper part of the spurs or projections when there is no flat zone 23. On the other hand, thanks to the flexibility of the retention elements 10.5 combined with the stepped zones 10.2, as shown in FIG. 2, the connector's 10 extraction from the counterpart or housing 11 is very easy and requires a minimum of force.

The spacer's disposition in two working positions "A" and "B", as shown in FIGS. 3 and 4, avoids the drawbacks mentioned earlier regarding the spacer's 17 disengagement when transported in a container between different plants. The features of the instant invention avoid the breakage of the retention elements and spurs 15 located in the bottom portion of the deformable zones or segments 13.1 when introducing the spacers 17, as well as insuring the spacer's extraction by means of the device 21 in case of a defective terminal assembly.

Figure 6:
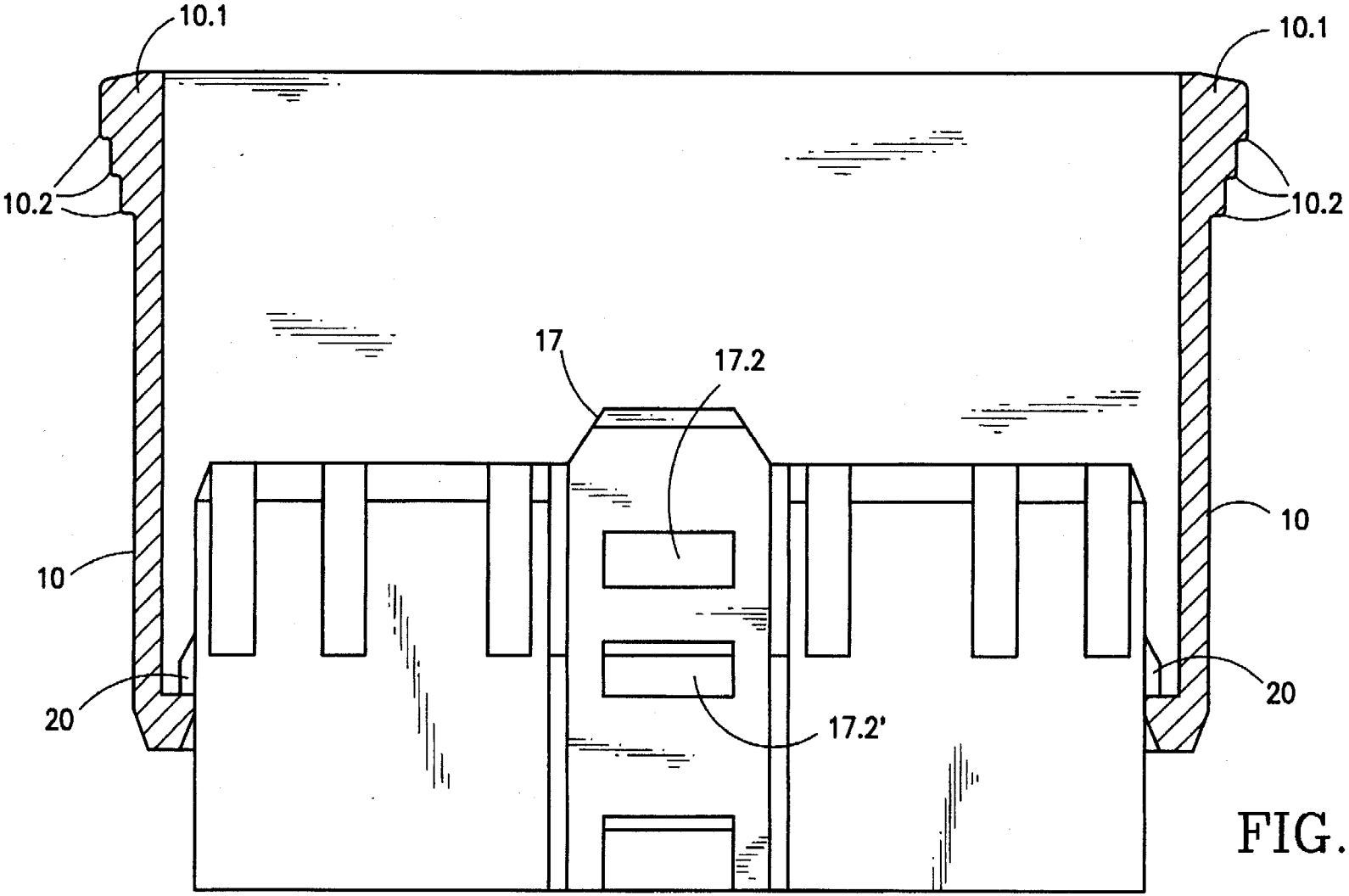
FIG. 6 is an elevation longitudinal section of a connector 10, showing one of the legs 17.1 of the spacer 17 and including spacer 17 humps 20 which avoid, together with the connector's base 10.6, the spacer 17 coming loose from the connector 10 because of undesired causes.

FIG. 6 is an elevation longitudinal section of a connector 10, showing one of the legs 17.1 of the spacer 17 and including spacer 17 humps or flanges 20 which avoid, together with the connector's base 10.6, the spacer coming loose from the connector 10 because of undesired causes.

It will be understood, after considering the drawings and explanations given that the present invention provides a simple and efficient construction easily practicable, resulting in a new industrial development.

With the full description of the invention corresponding with the appended drawings, it is understood that any convenient modification details can be introduced, provided that the variations do not fall out of the scope of the invention as stated in the appended Claims.

We claim:

1. An electrical connector adapted to releasably secure electrical terminals connected to electrical wires to a housing having an open end for receiving the connector, the connector comprising;

a connector body having first and second ends, said connector body including a first cavity for selectively receiving an electrical terminal and a second cavity for selectively receiving a spacer member, said first cavity having an inlet opening at said first end of said body and said second cavity having an inlet opening at said second end of said body, first and second partitions provided within said body, said first partition separating said first and second cavities and having a flexible portion adjacent said second end of said body, said flexible segment including a terminal retention portion, said second partition being oriented in opposing relationship to said first partition and on an opposite side of said second cavity and including a spacer member retention portion, said terminal retention portion of said flexible segment of said first partition being urged into said first cavity upon insertion of said spacer member within said second cavity, and a connector body retention member spaced from said second partition and having a free end adjacent said first end of said body, said free end being yieldable toward said second partition and including a retention portion which is selectively engageable with the housing when said second end of said connector body is inserted into the housing to thereby retain said connector body within the housing.

2. The electrical connector of claim 1 in which said spacer member is generally U-shaped including first and second legs, spaced openings in said second leg, and said spacer member retention portion of said second partition including a projection engageable within said spaced openings in said second leg to thereby retain said spacer member in selected positions within said second cavity.

3. The electrical connector of claim 2 in which said spacer member includes a base portion, said base portion extending from said second end of said body when said spacer member is in said first position wherein said projection of said second partition is engageable within a first of said openings in said second leg thereof and said base portion of said spacer member being generally flush with said second end portion of said body when in a second position relative to said body with said projection of said second partition being engageable within a second of said openings in said second leg of said spacer member.

4. The electrical connector of claim 3 wherein said first leg of said spacer member includes an abutment element positioned so as to abut an end wall of said flexible segment of said first partition when said spacer member is in said first position, whereby the projection of said spacer member from said second end of said connector body gives an indication that an electrical terminal is not properly seated within said first cavity.

5. The electrical connector of claim 4 in which said first leg of said spacer member includes a tip portion extending from said abutment element, said tip portion including outwardly extending flexible wall members.

6. The electrical connector of claim 4 in which said connector body retention member is integrally formed with said second partition, and an opening provided along said second partition so as to allow said connector body retention member to yield relative to an adjacent portion of said second partition.

7. The electrical connector of claim 6 in which said terminal retention portion of said flexible segment of said first partition includes an outwardly extending protrusion adapted to be seated within an opening formed within a terminal when the terminal is seated within said first cavity.

8. The electrical connector of claim 7 in which said body includes an enlarged wall portion adjacent said first end of said connector body and extending outwardly therefrom in a direction generally opposite from said connector body retention member, said connector body retention member including an outwardly extending portion which is selectively engageable so as to urge said connector body retention member inwardly of said connector body whereby said connector body is adapted to be released from engagement with the housing.

9. The electrical connector of claim 8 in which said first end of said connector body includes a flat wall extending adjacent to and in general alignment with said outwardly extending portion when said outwardly extending portion is not selectively engaged.

10. The electrical connector of claim 8 including a pair of flange elements extending outwardly from said spacer member generally parallel to said first and second partitions, said flanges being engageable with said connector body adjacent said second end thereof to thereby prevent the separation of said spacer member from said connector body.

11. The electrical connector of claim 1 in which said retention portion of said retention member includes an outwardly extending projection.

12. The electrical connector of claim 11 in which said connector body retention member is integrally formed with said second partition, and an opening provided along said second partition so as to allow said connector body retention member to yield relative to an adjacent portion of said second partition.

13. The electrical connector of claim 12 in which said terminal retention portion of said flexible segment of said first partition includes an outwardly extending protrusion adapted to be seated within an opening formed within a terminal when the terminal is seated within said first cavity.

14. The electrical connector of claim 1 including a pair of flange elements extending outwardly from said spacer member generally parallel to said first and second partitions, said flanges being engageable with said connector body adjacent said second end thereof to thereby prevent the separation of said spacer member from said connector body.

15. The electrical connector of claim 1 in which said connector body retention member is integrally formed with said second partition, and an opening provided along said second partition so as to allow said connector body retention member to yield relative to an adjacent portion of said second partition.

16. The electrical connector of claim 1 in which said terminal retention portion of said flexible segment of said first partition includes an outwardly extending protrusion adapted to be seated within an opening formed within a terminal when the terminal is seated within said first cavity.

17. The electrical connector of claim 1 in which said body includes an enlarged wall portion adjacent said first end of said connector body and extending outwardly therefrom in a direction generally opposite from said connector body retention member, said connector body retention member including an outwardly extending portion which is selectively engageable so as to urge said connector body retention member inwardly of said connector body whereby said connector body is adapted to be released from engagement with the housing.

18. The electrical connector of claim 1 including a pair of flange elements extending outwardly from said spacer member generally parallel to said first and second partitions, said flanges being engageable with said connector body adjacent said second end thereof to thereby prevent the separation of said spacer member from said connector body.

19. An electrical connector for releasably securing electrical terminals connected to electrical wires, the connector comprising;

a connector body having first and second ends, said second end being releasably receivable within a housing, said housing having an open end and opposing side walls with a slot formed in one of said side walls, said connector body including a first cavity for selectively receiving an electrical terminal and a second cavity for selectively receiving a spacer member, said first cavity having an inlet opening at said first end of said body and said second cavity having an inlet opening at said second end of said body, first and second partitions provided within said body, said first partition separating said first and second cavities and having a flexible portion adjacent said second end of said body, said flexible segment including a terminal retention portion, said second partition being oriented in opposing relationship to said first partition and on an opposite side of said second cavity and including a spacer member retention portion, said terminal retention portion of said flexible segment of said first partition being urged into said first cavity upon insertion of said spacer member within said second cavity, and a connector body retention member spaced from said second partition and having a free end adjacent said first end of said body, said free end being yieldable toward said second partition and including a retention portion which is selectively receivable within said slot in one of said side walls of said housing to thereby retain said connector body within said housing.

* * * * *